US006318801B1

(12) United States Patent
Tkafuji

(10) Patent No.: US 6,318,801 B1
(45) Date of Patent: Nov. 20, 2001

(54) STRUCTURE FOR SUPPORTING SEAT OF HEIGHT-ADJUSTMENT CHAIR

(76) Inventor: Hirosuke Tkafuji, 5-19, Ohasu Higashi 3-chome, Higashiosaka-shi, Osaka-fu, 577-0824 (JP)

( * ) Notice: Subject to any disclaimer, the term of this patent is extended or adjusted under 35 U.S.C. 154(b) by 0 days.

(21) Appl. No.: 09/599,836

(22) Filed: Jun. 23, 2000

(30) Foreign Application Priority Data

Jun. 23, 1999 (JP) ..... 11-176916

(51) Int. Cl.[7] ..... A47C 3/20
(52) U.S. Cl. ..... 297/338; 297/447.2
(58) Field of Search ..... 297/338, 331, 297/339, 447.2, 446.2

(56) References Cited

U.S. PATENT DOCUMENTS 4,793,654 12/1988 Takafuji .
5,511,855 * 4/1996 Miles ..... 297/338
5,868,469 * 2/1999 Ming ..... 297/338
6,017,089 * 1/2000 Mengshoel ..... 297/338

* cited by examiner

*Primary Examiner*—Anthony D. Barfield
(74) *Attorney, Agent, or Firm*—Browdy and Neimark

(57) ABSTRACT

A structure A for supporting the seat of a height-adjustable chair, the construction comprising leg members including a front leg unit 1 and an auxiliary leg 2 which are longitudinally disposed, and a bracket 4 having a front engagement piece 6 and a rear engagement piece 7 which are disposed in both of the front and rear sides of the leg members. When the bracket 4 is inclined rearward, it can be moved in the vertical direction along the leg members. When the bracket 4 is returned forward in a use state, the front and rear engagement pieces come into engagement with the leg members and the bracket 4 is fixed. A projection 13 is provided on a side face of the bracket 4. The projection 13 comes into contact with a side face of the leg member with a frictional action when the bracket 4 is inclined forward, and the contact is cancelled when the front side of the bracket 4 is lifted.

5 Claims, 15 Drawing Sheets

STRUCTURE FOR SUPPORTING SEAT OF HEIGHT-ADJUSTMENT CHAIR

BACKGROUND OF THE INVENTION

1. Field of the Invention

The present invention relates to a structure for supporting a seat of a height-adjustable chair.

2. Description of the Related Art

The applicant of the present invention has proposed a height-adjustable chair (chair with a height-adjustable seat) with a foldable seat of which height can be adjusted in a stepless manner (refer to Publications of Japanese Examined Utility Model Nos. 1-8204, 4-45562, and 1-11089 and the like). As shown in FIG. 14*a*, a typical height-adjustable chair comprises a front leg unit 101 on the outer side of an inverted almost U shape, an auxiliary frame 102 disposed on the inside of the front leg unit 101 with a gap, rear legs 103 closably attached to either the front leg unit or the auxiliary frame, a pair of right and left brackets 104 whose rear portions are positioned in the gap between the front leg unit 101 and the auxiliary frame 102, and a seat 105 attached to the top face on the front side of each of the brackets 104. In the rear portion of each of the brackets 104, as specifically shown in FIG. 14*b*, a front engagement piece 106 and a rear engagement piece 107 for maintaining the angle of the bracket 104 are provided.

As shown in FIGS. 15*a* and 15*b*, the distance between the front engagement piece 106 and the rear engagement piece 107 is set to be slightly wider than the dimention in the front/rear directions (thickness or diameter) of each of the front leg unit 101 and the auxiliary frame 102. Consequently, when the bracket 104 is inclined rearward as shown in FIG. 15*b*, the seat 105 can be moved vertically. When the seat 105 is inclined forward as shown in FIG. 15*a*, the front and rear engagement pieces 106 and 107 come into contact and engagement with the opposite faces of the front leg unit 101 and the auxiliary frame 102, so that they are fixed in the position. By retaining a retaining piece (reference numeral 109 in FIG. 14*b*) provided between the front leg unit 101 and the auxiliary frame 102 by a slit 108 at the rear end of the bracket 104 in the state where the front side of the seat 105 is lifted and folding the rear legs 103, the chair can be folded.

SUMMARY OF THE INVENTION

The above-mentioned height-adjustable chair has an advantage that the height can be adjusted only by slightly lifting the front end of the seat 105 and inclining the brackets 104 rearward to disengage the front and rear engagement pieces 106 and 107 from the front leg unit 101 and the auxiliary frame 102. The advantage causes, however, a problem such that the height changes even when the seat 105 is slightly lifted without user's intention. For example, also in the case where the user half rises to his/her feet, pulling the front end of the seat 105 to the front to move the chair forward, the front and rear engagement pieces 106 and 107 of the bracket 104 are disengaged from the front leg unit 101 and the like. When the user sits on the chair, the engagement pieces 106 and 107 have to be re-engaged with the front leg unit 101 and the like at a proper height.

A technical subject of the present invention is to provide a structure for supporting a seat of a height-adjustable chair in which the height of the seat 105 hardly changes even if the user moves the seat 105 a little while maintaining the convenience of the conventional height-adjustable chair.

According to the present invention, there is provided a structure for supporting a seat of a height-adjustable chair, the structure comprising a leg member longitudinally disposed, and a bracket having a front engagement piece and a rear engagement piece which are disposed on the front and rear sides of the leg member, respectively, with spacing larger than the thickness of the leg member, and the bracket being vertically movable along the leg member when the bracket is inclined rearward and being fixed when the bracket is returned forward in a use state and the front and rear engagement pieces come into engagement with the leg member, wherein a frictional stopper is provided on a side face of either the leg member or the bracket, which comes into contact with a side face of the other member with a frictional function in the use state and which is disengaged from the side face in a state where the front side of the bracket is lifted.

The supporting structure can be applied to a height-adjustable chair in which the leg member has two right and left rod members which are arranged with spacing and the rear portion of the bracket is positioned vertically in the spacing between the rod members, in a manner similar to the conventinal chair. In this case, it is preferable that the frictional stopper is a projection provided on a side face of the rear portion of the bracket so as to come into contact with a side face of the rod member in the use state.

When the leg member is constructed by two rod members, preferably, the projections are provided on both faces of the rear portion of the bracket. More preferably, the bracket is a plate member, the projections provided on both faces are projection members of the same shape which are disposed on both faces of the plate member, and each of the projection members has a male shaft and a female shaft. The male shaft penetrates a hole formed in the bracket and fixedly fit into to the female shaft.

Preferably, the frictional stopper is a resilient or elastomeric member made of a high polymer material.

In a supporting structure of the invention, in a use state where the bracket is inclined forward, the front and rear engagement pieces are engaged with the front and rear sides of the leg member to check further forward inclination of the seat. In such a state, since the frictional stopper provided on a side of either the bracket or leg member is abutted against the side face of the other member with a frictional function, the angle and height of the bracket relative to the leg member do not easily change. Even when the front end of the seat is slightly pulled upward to thereby slightly swing the seat rearward, the seat swings merely in the position but is just returned to the original state when the user moves his/her hand off. Therefore, even when the user holds the seat and moves the chair in the front-rear direction, the height of the seat does not change. On the other hand, when the bracket is largely inclined rearward, the engagement between the frictional stopper and the other member is cancelled. Since the front and rear engagement pieces are disengaged from the leg member in such a state, the bracket can be freely moved vertically.

In the case where two right and left rod members are adopted as the leg member, the rear portion of the bracket is positioned between the rod or bar members, and a projection formed on a side face of the rear portion of the bracket is used as the frictional stopper, the projection comes into contact with the inner face of the rod member when the seat is set in the use state, and the projection comes off from the rod member when the seat is inclined rearward. Proper position and range of the projection in the bracket can be selected according to the degree of the rearward inclination of the bracket, at which the projection comes off from the rod member. The supporting structure of the invention can be applied to the conventional height-adjustable chair only by providing the projection on a side face of the r ear portion of the bracket. It is therefore easy to carry out the invention.

When the projections are provided on both faces of the bracket, the angle-maintaining function of the frictional stopper becomes more stable. Further, when the projection members of the same shape are used as the frictional stoppers provided on both faces of the bracket, the parts can be commonly used, the manufacturing cost can be reduced, and the parts management is facilitated.

When the resilient or elastomeric member made of a high polymer material is used as the frictional stopper, a fixing force based on the friction is stabilized. The engagement and disengagement can be smoothly switched. Hereinafter, some embodiments of the structure of supporting the seat of a height-adjustable chair of the invention will now be described with reference to the drawings.

DETAILED DESCRIPTION OF THE INVENTION

Figure 1:
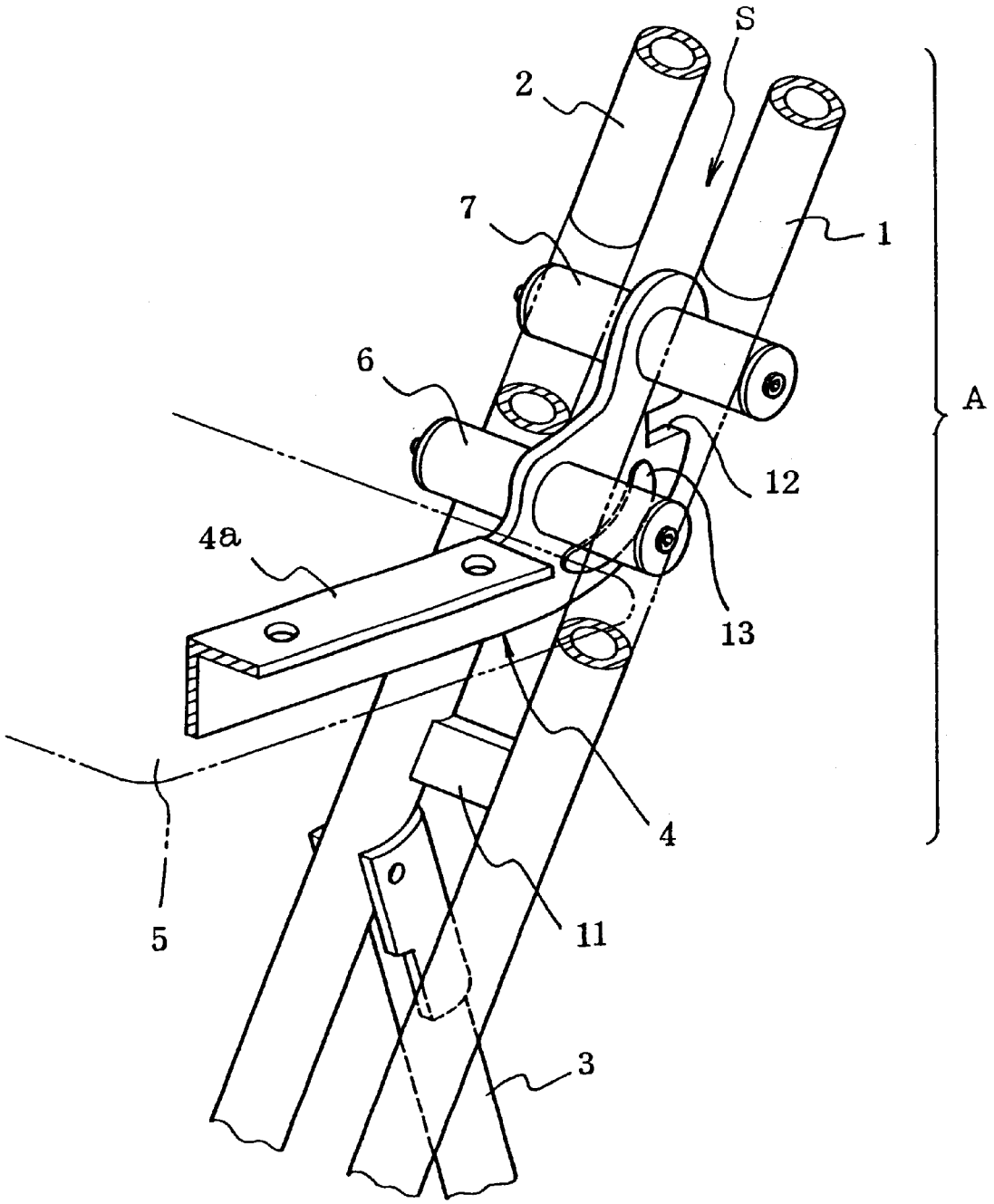
FIG. 1 is a partially notched perspective view showing an embodiment of the supporting structure of the invention.
Figure 15A:
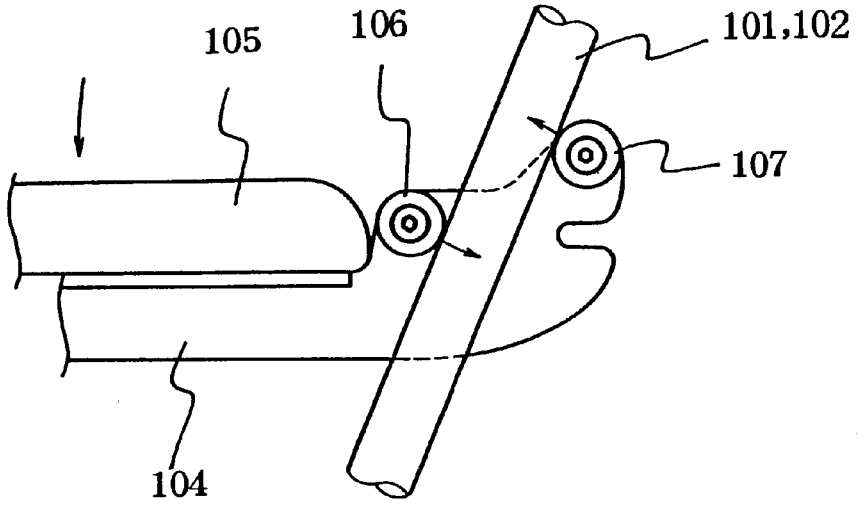
FIGS. 15*a* and 15*b* are side views showing the action of the supporting structure.
Figure 15B:
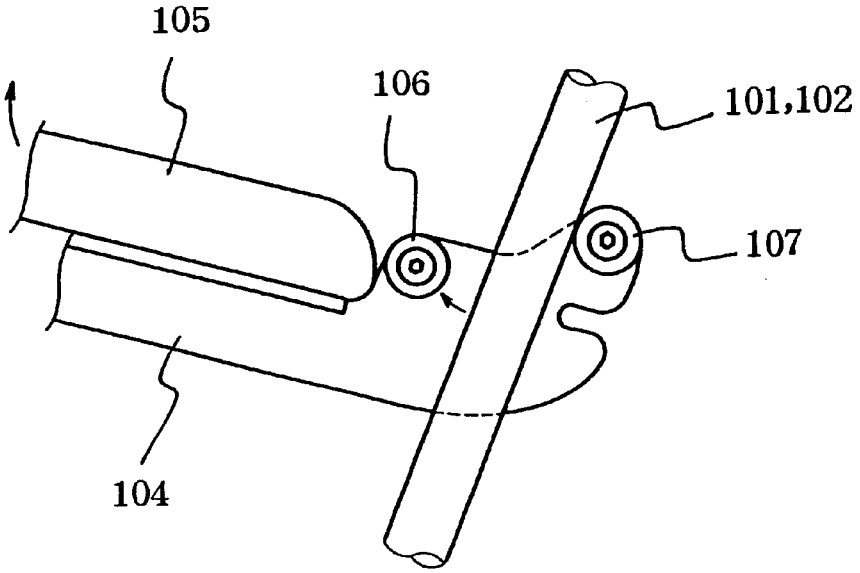

FIG. 1 shows an example of applying the supporting structure of the invention to a conventional height-adjustable chair (refer to FIG. 15). This supporting structure A comprises a front leg unit 1, an auxiliary frame 2 disposed apart from the front leg unit with a gap S, and a bracket 4 which rear portion is inserted through the gap S. Each of the front leg unit 1 and the auxiliary frame 2 corresponds to a leg member in claim 1. In the embodiment, the front leg unit 1 and the auxiliary frame 2 are supported by a foldable rear leg (reference numeral 3 in the drawing) and are disposed vertically so as to be slightly inclined rearward.

Figure 2A:
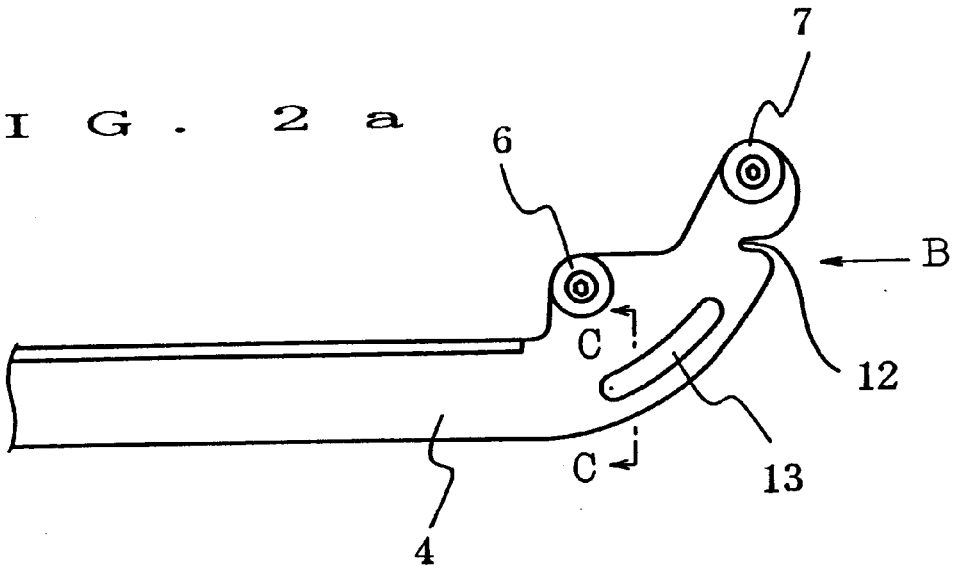
FIG. 2*a* is a side view of a bracket used for the supporting structure.
Figure 2B:
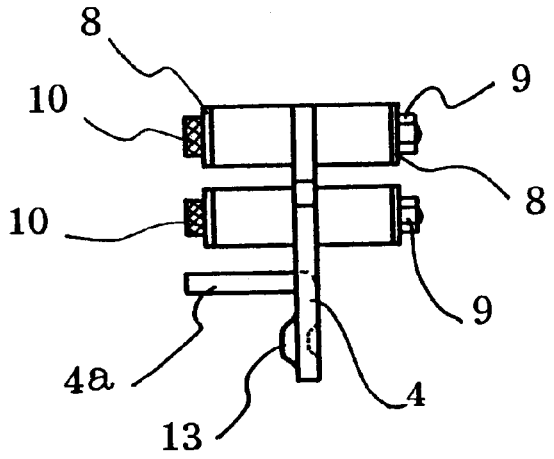
FIGS. 2*b* and 2*c* are a view seen from the arrow B and a cross section taken along line C—C of FIG. 2*a*, respectively.

The bracket 4 has a horizontal portion 4*a* which is obtained by punching a metal thin plate such as a steel plate in a predetermined shape and bending a part of the front portion and on which a seat (refer to reference numeral 5 in FIG. 3) is placed. The other portion of the bracket 4 is oriented in the vertical direction. The rear portion of the bracket 4 has a wide shape which is curved upward. Front engagement pieces 6 and 6 are attached to the right and left sides of the front side of the rear portion, and rear engagement pieces 7 and 7 are attached to the upper side of the rear end. The engagement pieces 6 and 7 take the form of, for example, cylindrical rubber pieces. As shown in FIG. 2*b*, the engagement pieces 6 and 7 are fixed to the bracket 4 by washers 8, screws 9 penetrating the bracket 4 and nuts 10. The bracket 4 has a slit 12 at the rear end thereof. The seat therefore can be retained by engaging the sliut 12 on a retaining piece 11 provided between the front leg unit 1 and the auxiliary frame 2 when the seat is folded.

Figure 2C:
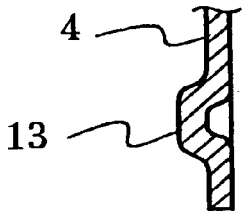

The front leg unit 1, auxiliary frame 2, bracket 4, front and rear engagement pieces 6 and 7 and the like are substantially the same as those in the supporting structure in the conventionally known height-adjustable chair (refer to FIG. 15). The supporting structure of the this embodiment is characterized in that a projection 13 is formed on the outside face of the rear portion of the bracket 4, that is, on the face opposite to the front leg unit 1. As shown in FIG. 2*a*, the projection 13 has a an arc shape extending in the longitudinal direction along the lower edge of the bracket 4. Such a projection 13 can be easily formed by, for example as shown in FIGS. 2*b* and 2*c*, pressing the inner face (right side in FIG. 2*c*) of the steel plate constructing the bracket 4 so as to be recessed.

The plan shape of the projection 13 (shape seen from the side face as in FIG. 2*a*) is not especially limited. In FIG. 2*a*, from the viewpoint of designing, the arc shape along the lower edge of the bracket 4 is used.

However, various shapes such as rectangle, circle, and oval can be adopted. It is preferable to make the projection 13 extending in the longitudinal direction to a certain degree so that the projection 13 is not easily come off from the front leg unit 1 and the auxiliary frame 2. The sectional shape of the projection 13 is not also especially limited. Besides the arc shape shown in FIG. 2*c*, various sectional shapes such as trapezoid and rectangle can be adopted. Preferably, a flat face is formed at the upper end (left side of FIG. 2*c*) so that the contact between the front leg unit 1 and the auxiliary frame 2 is stabilized and a moderate frictional force acts. In the flat face, a recess adapted to the external shape of the front leg unit 1 may be formed so that the front leg unit 1 is fit in the recess in a use state. In this case, in addition to the frictional force, a resistance acts since the front leg unit has to overcome the recess, so that the angle of the bracket 4 becomes more stable.

Figure 3A:
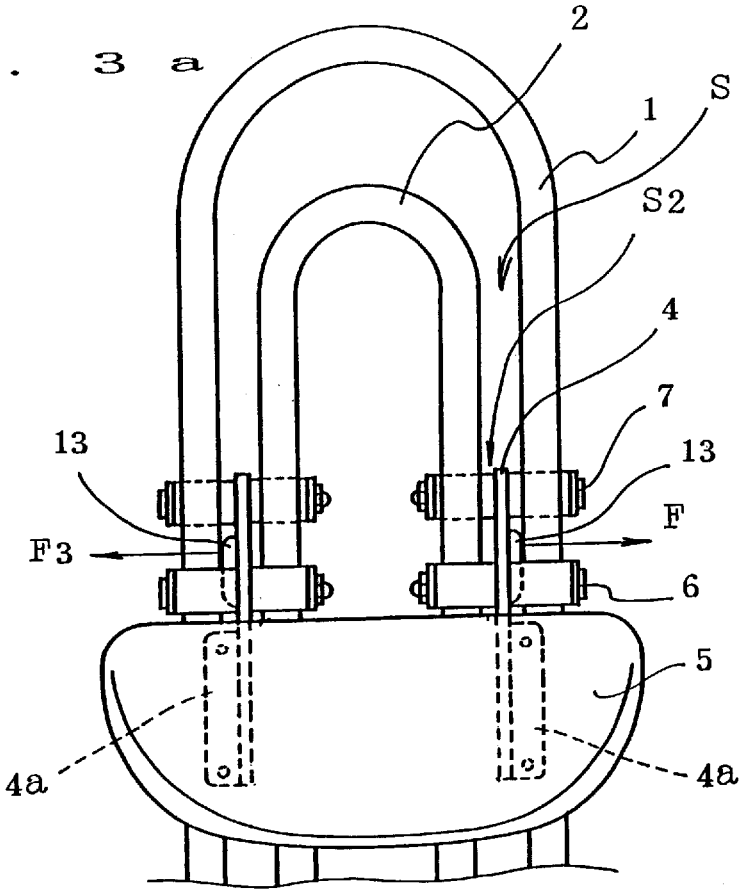
FIGS. 3*a* and 3*b* are front and plan views of the main portion of a chair having the supporting structure of FIG. 1, respectively.
Figure 3B:
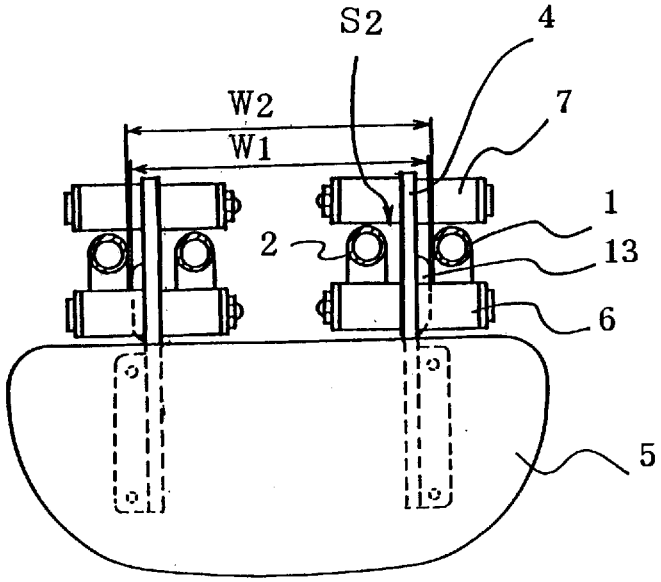

As shown in FIGS. 3*a* and 3*b*, the bracket 4 having the projection 13 is attached in each of a pair of right and left gaps S formed between the front leg unit having an inverted U shape and the auxiliary frame 2 disposed on the inside of the front leg unit. The brackets 4 are the pair of right and left symmetrical brackets. By attaching the seat 5 to the horizontal portions 4*a* of the brackets 4, the pair of brackets 4 are integrated. In the attached state, as shown in FIG. 3*b*, spacing W1 between the surfaces of the right and left projections 13 is rather wider than spacing W2 between the inner faces of the front leg units 1. In the embodiment, spacing between the inner faces of the right and left brackets is wider than spacing between the outer faces of the auxiliary frame 2. Consequently, there is a gap S2 between the inner face of the bracket 4 and the outer face of the auxiliary frame 2.

In the supporting structure A constructed as mentioned above, as shown in FIG. 4*a*, when the seat 5 and the brackets 4 are inclined forward so as to make a seatable state, in a manner similar to the conventional chair, by forward couple of force based on the weight of the seat 5 and the bracket 4, the front engagement piece 6 comes into contact with the front face of the front leg unit 1 and the auxiliary frame 2 (arrow F1) and the rear engagement piece 7 comes into contact with the rear face of the front leg unit 1 and the auxiliary frame 2 (arrow F2). By a frictional action based on the contact force, the seat 5 is fixed at the height. Further, when the user sits on the seat 5, the torque becomes larger and it makes the frictional force further increase. The seat 5 does not therefore slide downward.

Figure 4A:
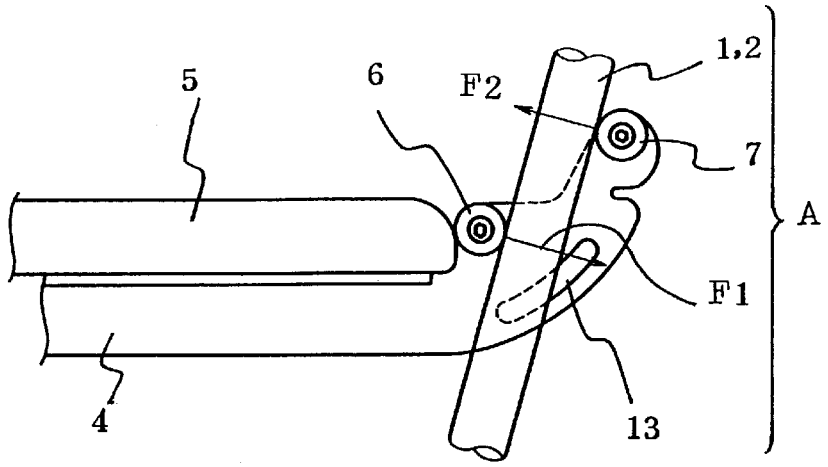
FIGS. 4*a* to 4*c* are side views showing functions of the supporting structure of FIG. 1.

In the supporting structure A, when the seat 5 is inclined to be in a horizontal position as shown in FIG. 4*a*, the projection 13 of the bracket 4 is pushed so as to be in contact with the inner face of the front leg unit 1. The bracket 4 and/or the front leg unit 1 are resiliently deformed and the restoring force acts as a pressing force between the surface of the projection 13 and the inner face of the front leg unit 1 (refer to arrow F3 in FIG. 3*a*). Although the pressing force acts to widen the right and left stick members of the front leg unit 1, the stick members are supported by a proof tensile force which occurs in the curved portion at the upper end of the front leg unit 1 and a lateral rod. The reactive force to narrow the spacing between the right and left brackets 4 is supported by a proof compressive force of the seat 5 connecting the right and left brackets 4. By the pressing force, a frictional force occurs between the projection 13 and the inner face of the front leg unit 1, so that the angle of the brackets 4 to the front leg unit 1 and the auxiliary frame 2 is stabilized. Even when the user half rises to his/her feet and lifts the seat 5 a little and the forward torque of the bracket 4 is lost, the bracket 4 does not therefore slide down.

Figure 4B:
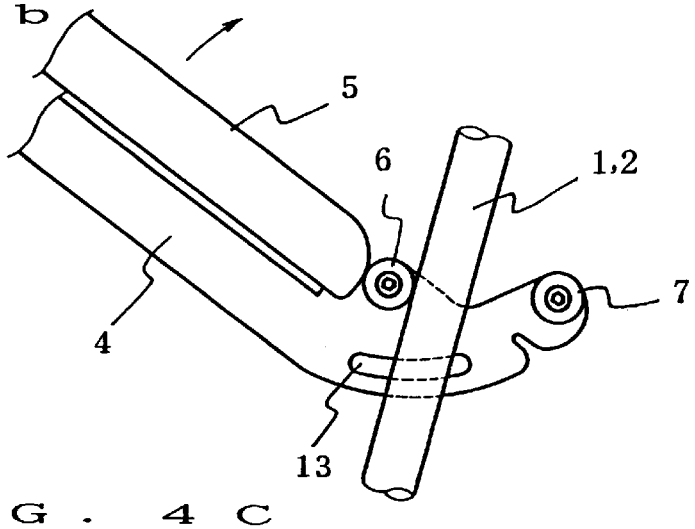

When the front end of the seat 5 is slightly lifted to thereby make the bracket 4 swing rearward a little, as shown in FIG. 4*b*, the bracket 4 swings around the contact portion of the front engagement piece 6, the front leg unit 1 and the auxiliary frame 2 as a fulcrum and the contact portion of the projection 13 and the front leg unit 1 (portion where they cross each other) is deviated a little rearward. In this case as well, the frictional engagement is not cancelled. When the user moves his/her hand off the seat 5 and the seat 5 is inclined forward, the bracket 4 swings forward around the contact portion of the projection 13 and the front leg unit 1 as a fulcrum, and the front engagement piece 6 and the rear engagement piece 7 come into engagement with the front face of the front leg unit 1 and the rear face of the auxiliary frame 2, respectively, and the bracket 4 returns to the state of FIG. 4*a*. Consequently, when the user sits on the seat 5 in such a state, the height which has been set is almost maintained.

Figure 4C:
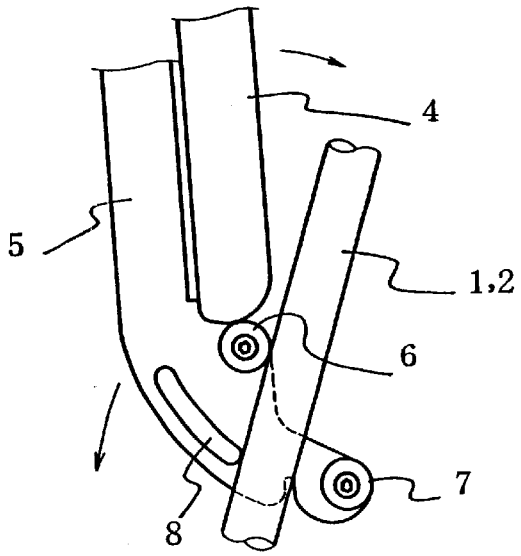

When the user wishes to change the height of the seat 5 intentionally, as shown in FIG. 4*b*, the user lifts the front end of the seat 5. In this case, although the frictional engagement between the projection 13 and the front leg unit is not cancelled only by lifting the seat 5 a little as described above, when the bracket 4 is lifted at a certain angle or larger around the front engagement piece 6 as a fulcrum, as shown in FIG. 4*c*, the projection 13 is disengaged from the front leg unit 1. In this state, the front and rear engagement pieces 6 and 7 and the front leg unit 1 and the auxiliary frame 2 are also disengaged from each other, so that the seat 5 can be freely moved in the vertical direction. By selecting a proper height and inclining the seat 5 forward, the seat 5 can be again fixed at the selected height as shown in FIG. 4*a*.

In the case of folding the chair, in a manner similar to the conventional chair, it is sufficient to lift the seat 5 so as to be in contact with the front face of the front leg unit 1 and that of the auxiliary frame 2 and then move the seat 5 downward so that the retaining piece (refer to reference numeral 11 in FIG. 1) is retained by the slit 12 at the rear end of the bracket 4.

Although the projection 13 is formed on the outer face of the bracket 4 in the supporting structure A, it can be formed on the inner face. In this case, the projection 13 and the auxiliary frame 2 comes into frictional engagement with each other. The pressing force between the projection 13 and the auxiliary frame 2 is offset by the proof compressive force of the curved portion in the upper part and the lateral rod in the lower part for connecting the right and left stick members of the auxiliary frame 2. The force to widen the right and left brackets 4 is cancelled by the seat 5. In the foregoing embodiment, a gap is provided between the inner side of the bracket 4, that is, the face on which the projection 13 is not formed and the outer face of the auxiliary frame 2. A gap, however, may not be provided. In this case, the bracket 4 is tightly fit in the gap between the front leg unit 1 and the auxiliary frame 2, so that a stronger frictional engagement force can be obtained.

Figure 5A:
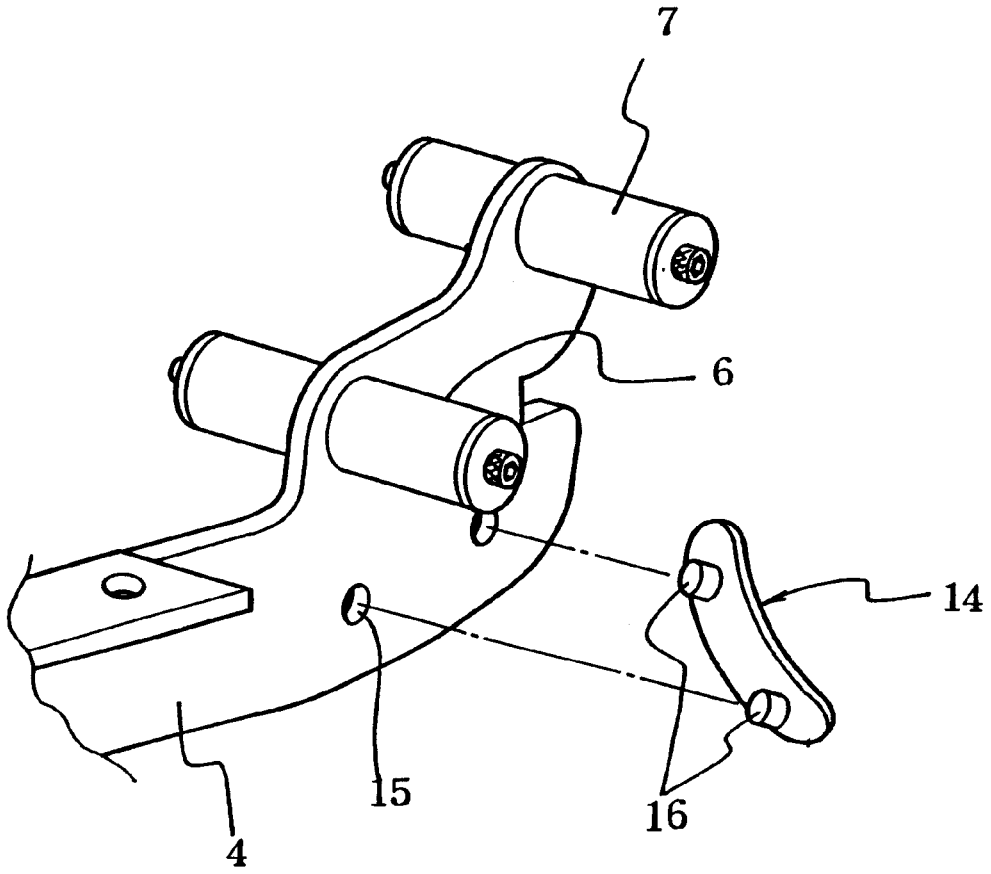
FIG. 5*a* is a perspective view of the main portion showing another embodiment of a bracket according to the invention.
Figure 5B:
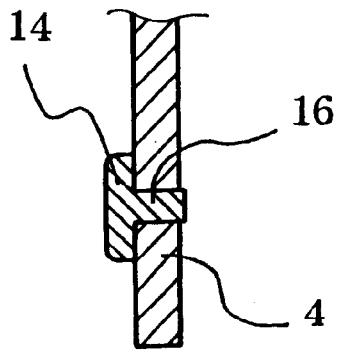
FIG. 5*b* is a cross section showing an attaching state of a projection member of the bracket.

Although the projection 13 is formed by stamping the bracket 4 made by a metal thin film with a press in the embodiment, as shown in FIG. 5*a*, a projection member 14 separately manufactured may be fixed to the bracket 4. In the embodiment, through holes 15 are opened in the bracket 4 and fitting shafts 16 formed on one face of the projection member 14 so as to project are fit into the through hole 15 and are fixed as shown in FIG. 5*b*. The projection member 14 may be fixed by either one or a combination of a screw, an adhesive, a double-faced tape, or the like.

Since the projection member 14 may be manufactured of a material different from that of the bracket 4, the strength of the frictional force acting between the projection 13 and the front leg unit 1 or the auxiliary frame 2 can be relatively easily selected. It can be made of a high polymer material such as hard or soft synthetic resin, rubber and the like. In this case, even when the projection member 14 is in slidable contact with the surface of the front leg unit 1 and the auxiliary frame 2, it does not usually cause damage to the front leg unit 1 and the auxiliary frame 2. In the case of manufacturing the projection member 14 of elastic materials such as a soft synthetic resin or a rubber, also in the case where the degree of elastic deformation of the front leg unit 1 and the auxiliary frame 2 is low, a manufacture error and the like can be absorbed by the elastic deformation of the projection member 14. Consequently, there is an advantage that variation in frictional force is small.

Figure 6A:
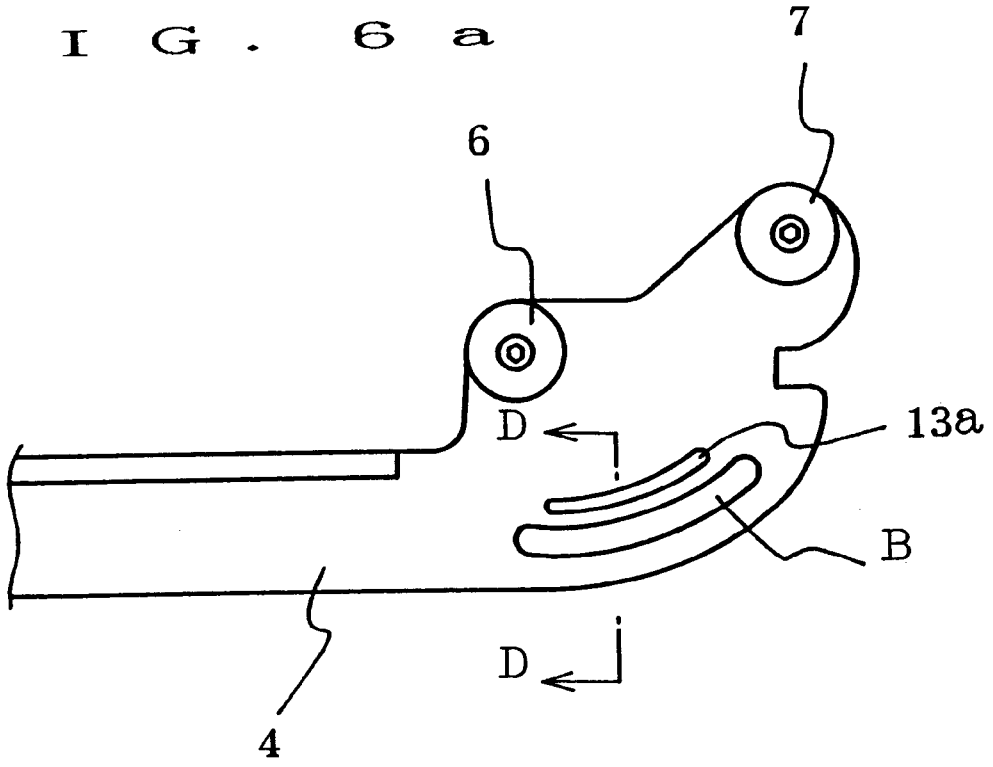
FIG. 6*a* is a side view showing further another embodiment of a bracket according to the invention.
Figure 6B:
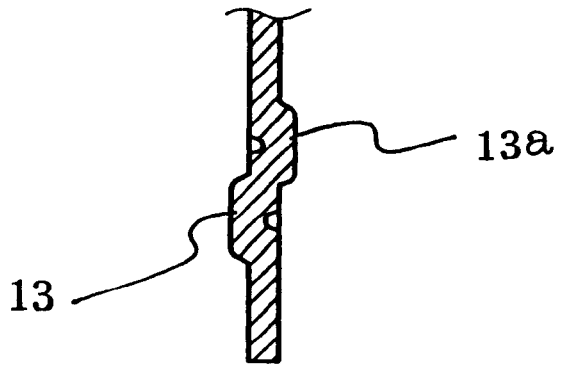
FIG. 6*b* is a cross section taken along line D—D of FIG. 5*a*.

FIGS. 6*a* and 6*b* show an embodiment in which projections 13 are formed on both faces of the bracket 4. In the embodiment, not only the projection 13 projected from the outer face (face opposite to the front leg unit 1) in the rear portion of the bracket 4 but also a projection 13*a* which projects from the inner face (face opposite to the auxiliary frame 2) is formed on the upper side of the projection 13. As shown in FIG. 6*b*, the projection 13*a*which projects from the inner face can be also formed by stamping the outer face side of the metal thin plate constructing the bracket 4 by a press work.

Figure 7A:
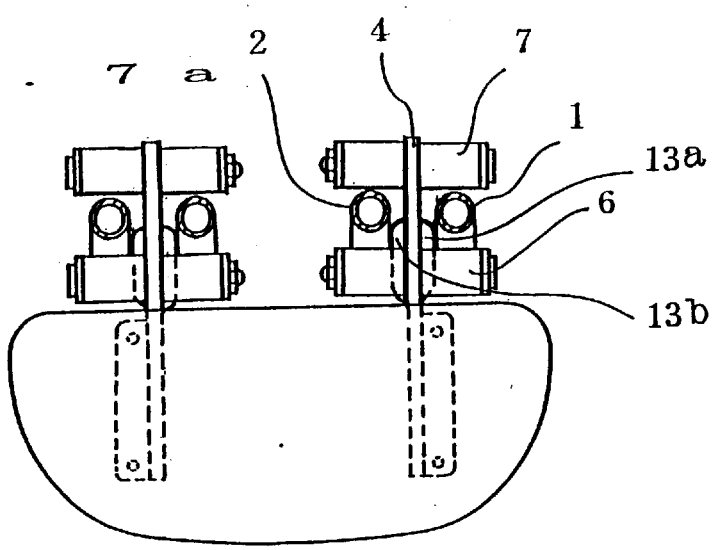
FIGS. 7*a* and 7*b* are plan and front views of the main portion of another embodiment of a chair having the supporting structure of the invention.
Figure 7B:
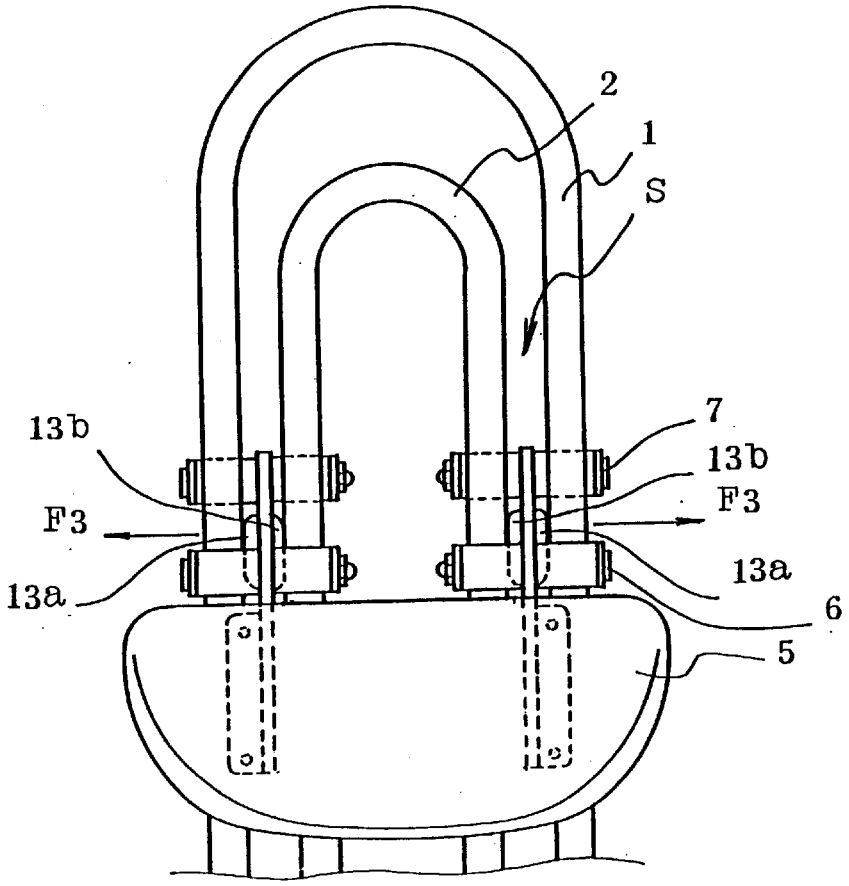

In the case of forming the projections 13 and 13*a*on both faces of the bracket 4, as shown in FIGS. 7*a* and 7*b*, the projection 13 on the outer face side comes into contact with the inner face of the front leg unit 1 and the projection 13*a* on the inner face side comes into contact with the outer face of the auxiliary frame 2. That is, the projections 13 and 13*a* on both faces of the bracket 4 are fit in the gap S between the front leg unit 1 and the auxiliary frame 2. That is, the region on which the frictional force acts is doubled and the stability of the angle of the bracket 2 is further improved. Further, since the pressing force received by both of the projections 13 and 13*a* is cancelled by the region, irrespective of the resiliency of the bracket 4 and the rigidity of the seat 5, a stable supporting structure can be obtained. In the case of the structure, it is not always necessary to provide projections for each of the right and left brackets 4. The projections 13 and 13*a* may be provided only on the surface and back face of either the right or left bracket. In order to balance the right and left brackets, however, it is preferable to provide the projections for both of the brackets.

Figure 8A:
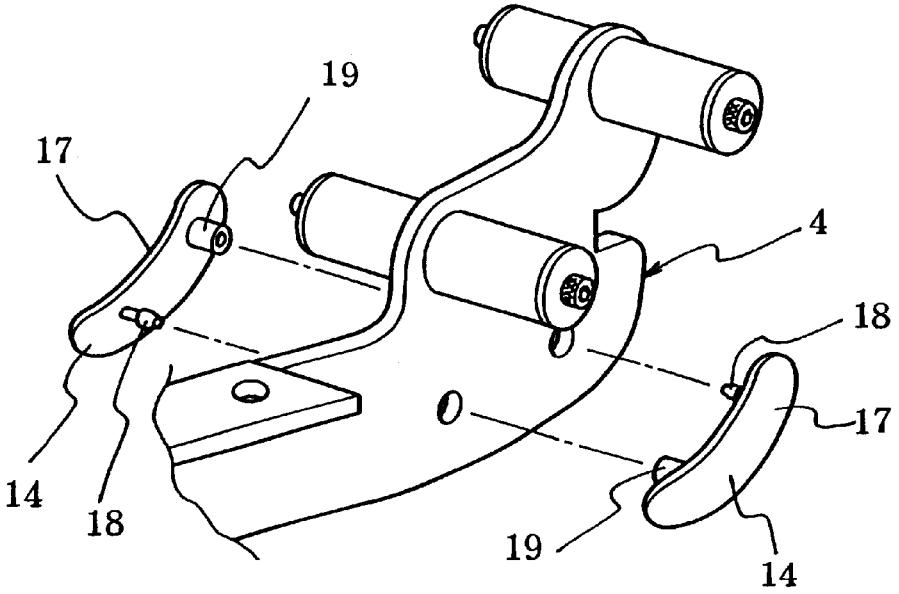
FIG. 8*a* is a perspective view of the main portion showing further another embodiment of the bracket according to the invention.
Figure 8B:
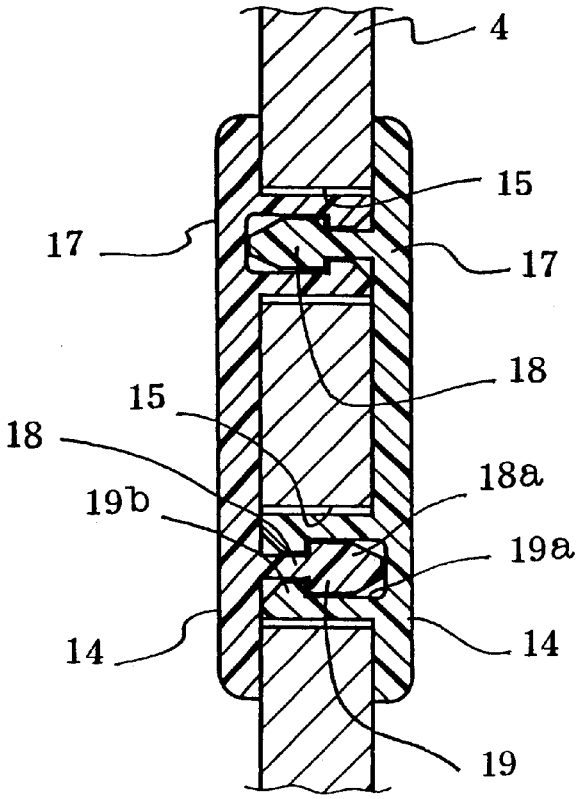
FIG. 8*b* is a cross section showing an attaching state of a projection member of the bracket.

The bracket 4 shown in FIG. 8*a* is provided with projection members 14 on both right and left faces. Each of the projection members 14 has a flat portion 17, a male shaft 18 and a female shaft 19. The male and female shafts 18 and 19 are positioned apart from each other and project from the inner face side of the projection member 14. As shown in FIG. 8*b*, the male shaft 18 has an expanded portion 18*a* at the tip. The female shaft 19 has a fitting hole 19*a* into which the expanded portion 18*a* is fit. Around the opening of the fitting hole 19*a*, a step 19*b*which comes into engagement with the expanded portion 18*a* is provided. In a manner similar to the projection member 14 shown in FIG. 5, the projection member 14 can be made of a soft or hard synthetic resin, rubber, or the like.

In the embodiment, the same projection members 14 are used for the surface and back face. As shown in FIG. 8*b*, the male shaft 18 and the female shaft 19 of one of the projection members 14 are inserted to two through holes 15 opened in the base plate of the brackets 4 and the other female and male shafts 19 and 18 are resiliently fit, thereby fixing the projection members 14 to the base plate of the bracket 4. An adhesive may be used jointly. When the projection members 14 are made of a relatively hard material such as a hard synthetic resin, two or three slits may be opened axially around the opening of the female shaft 19 so that the hole is easily opened.

Figure 9A:
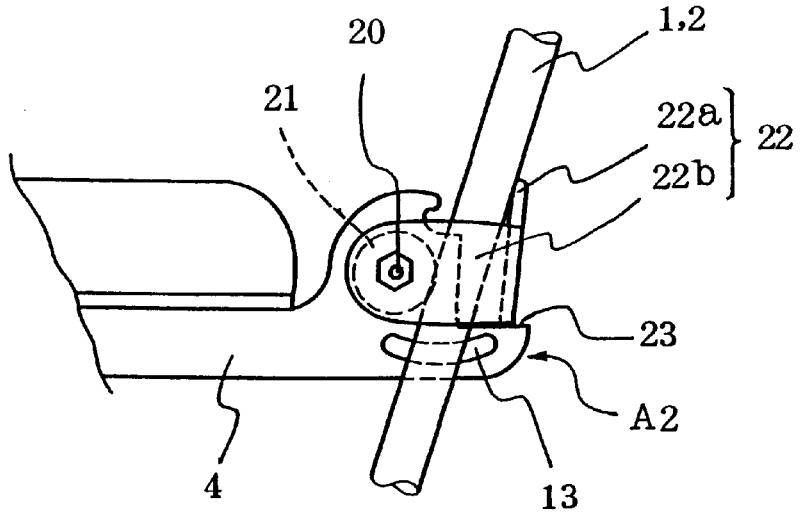
FIGS. 9*a* and 9*b* are side view and partially notched perspective view showing further another embodiment of the supporting structure of the invention, respectively.
Figure 9B:
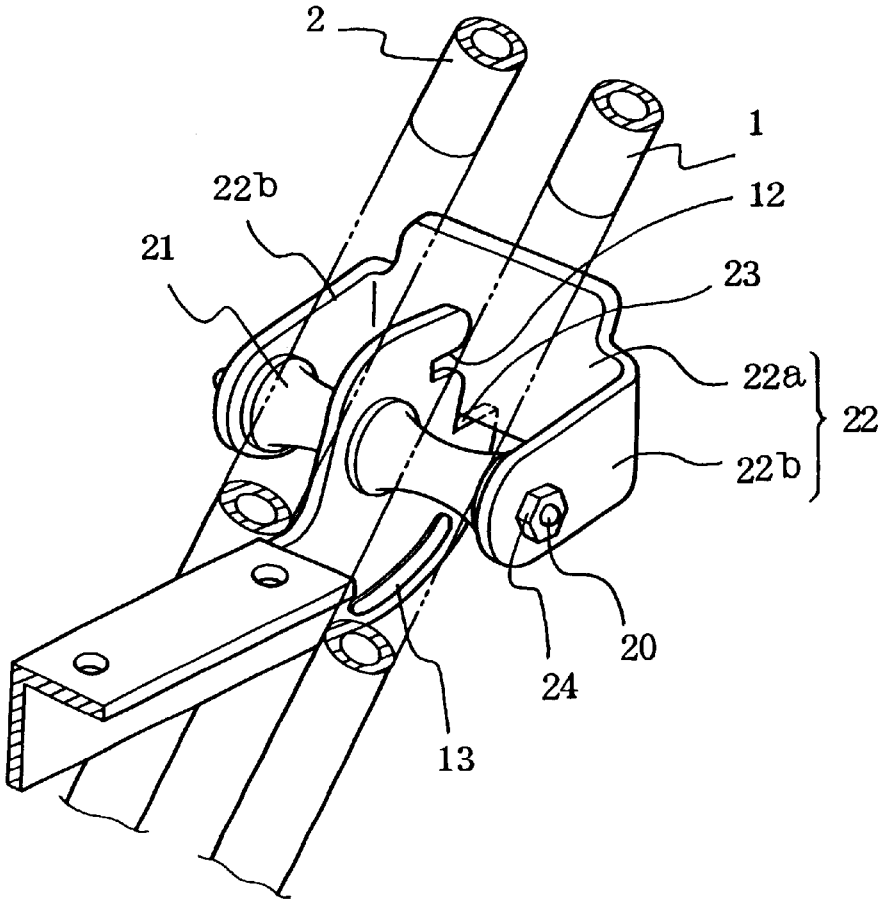

In a supporting structure A2 shown in FIGS. 9*a* and 9*b*, a front engagement piece 21 is coaxially rotatably attached to a shaft 20 which is fit to the bracket 4. Further, a rear engagement piece 22 is attached to the shaft 20. The shaft 20 is mounted so as to penetrate the bracket 4 and project from the right and left ends of the bracket 4. The cylindrical or hourglass-shaped front engagement piece 22 is rotatably attached to the shaft 20 which protrudes on both sides. Preferably, the front engagement piece 22 is made of a hard synthetic resin. The front leg unit 1, auxiliary frame 2, seat 5, and the like are the same as those in the foregoing embodiment.

The rear engagement piece 22 has an engagement portion 22*a* in a flat plate shape disposed behind the front leg unit 1 and the auxiliary frame 2 and arms 22*b* extending from both ends of the engagement portion 22*a* to the front. The rear engagement piece 22 has a U shape in plan view. The tips of the right and left arms 22*b* are attached so as to be swingable to the ends of the shaft 20 protruding from the ends of the front engagement piece 21. A notch 23 which comes into contact with the engagement portion 22*a* of the rear engagement piece 22 to regulate rearward swing of the rear engagement piece 22 is formed in the rear end of the bracket 4. A nut 24 for preventing the rear engagement piece 22 from coming off is fixed to each of the ends of the shaft 20. The slit 12 for engaging with the retaining piece (refer to reference numeral 11 in FIG. 1) provided for the front leg unit 1 and the auxiliary frame 2 is formed at the rear end of the bracket 4.

Also in the embodiment, the projection(s) 13 similar to those in FIGS. 1, 5, 8 and the like are provided on both or one of the faces of the rear portion of the bracket 4.

In the supporting structure A2 constructed as described above, when the seat 5 is inclined forward to the horizontal as shown in FIG. 9*a*, the front engagement piece 21 comes into contact with the front face of the front leg unit 1 and the auxiliary frame 2, and the upper periphery of the engagement portion 22*a* of the rear engagement piece 22 comes into contact with the rear face of the front leg unit 1 and the auxiliary frame 2. Consequently, in a manner similar to the foregoing embodiment, the seat is fixed at the height. Since the notch 23 of the bracket 4 comes into engagement with the lower periphery of the engagement portion 22*a* of the rear engagement piece 22, the rear engagement piece 22 does not swing forward more than that. Further, the projection(s) 13 provided on one or both of the faces of the bracket 4 is (are) in contact with the inner face of the front leg unit 1 or the outer face of the auxiliary frame 2 while displaying the frictional action. Even when the bracket 4 is inclined a little rearward, therefore, the seat 5 does not slide down.

In the case of changing the height of the seat 5 in the supporting structure A2, the bracket 4 is swung rearward around the shaft 20 as a center. The contact with friction between the projection 13 of the bracket 4 and the front leg unit 1 or the like is cancelled. In this case, the front engagement piece 21 and the rear engagement piece 22 stop tightly sandwiching the front leg unit 1 and the auxiliary frame 2. Consequently, the user can easily make the front engagement piece 21 and the rear engagement piece 22 vertically slide along the front leg unit 1 and the auxiliary frame 2 by lifting the front end of the seat 5. The user again inclines the seat 5 and the bracket 4 forward at a proper height, so that the front leg unit 1 and the auxiliary frame 2 are sandwiched by the front and rear engagement pieces 21 and 22 and the projection 13 comes into engagement with the front leg unit 1 or the like with a frictional action. In the case of folding the chair, in a state where the bracket 4 is swung rearward, the retaining piece is retained by the slit 12.

In the supporting structure A2, since the seat 5 and the bracket 4 swing around the shaft 20 as a center and the front and rear engagement pieces 21 and 22 move vertically while rotating or sliding the front engagement piece 21 along the front leg unit 1 and the auxiliary frame 2, the height adjusting operation and the folding operation can be easily performed. Moreover, since the bracket 4 is provided with the projection 13, once the seat 5 is inclined forward, the seat 5 is securely fixed in the position. Generally, in a chair of this kind, if the operation of vertically moving the chair 5 is easy, the function of holding the height is inferior and the height is changed when the seat 5 is moved only a little. As described above, however, the supporting structure A2 has an advantage that it can achieve both of the functions.

Figure 10:
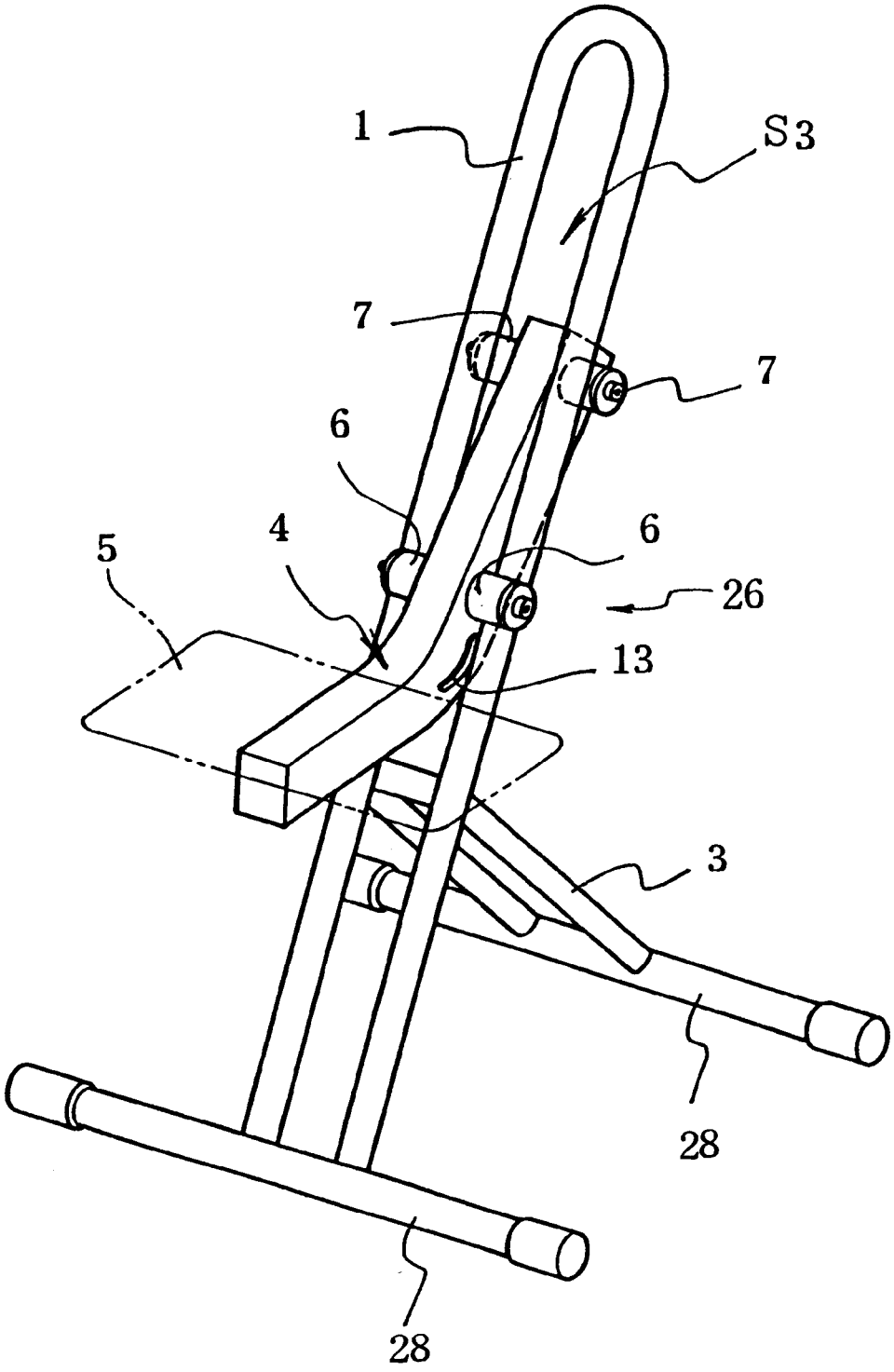
FIG. 10 is a perspective view showing further another embodiment of a chair having the supporting structure of the invention.

In the foregoing embodiments, the supporting structure of the invention is applied to a height-adjustable chair of a type such that the front leg unit 1 and the auxiliary frame 2 each having an inverted U shape are combined and the rear portion of each of the pair of right and left brackets 4 is inserted to the gap S between the front leg unit 1 and the auxiliary frame 2. The supporting structure of the invention, however, can be also applied to chairs of other types. For example, in a chair 26 of FIG. 10, the spacing between the right and left rod members of the front leg unit 1 in the inverted U shape is narrowed and the auxiliary leg is omitted. A relatively long lateral rod 28 is attached to the lower end of the front leg unit 1 and the lower end of the rear leg 3 which is foldably connected to the front leg unit 1. Further, the rear portion of a relatively thick bracket 4 is inserted into a gap S3 in the front leg unit 1, and a seat 5 is attached to the front portion of the bracket 4.

The front and rear engagement pieces 6 and 7 are attached to the rear portion of the bracket 4. Further, projections 13 are provided on both right and left faces of the bracket 4. Also in the case of applying the supporting structure of the invention to the chair having one bracket 4, the actions and effects substantially the same as those described above are produced.

Figure 11A:
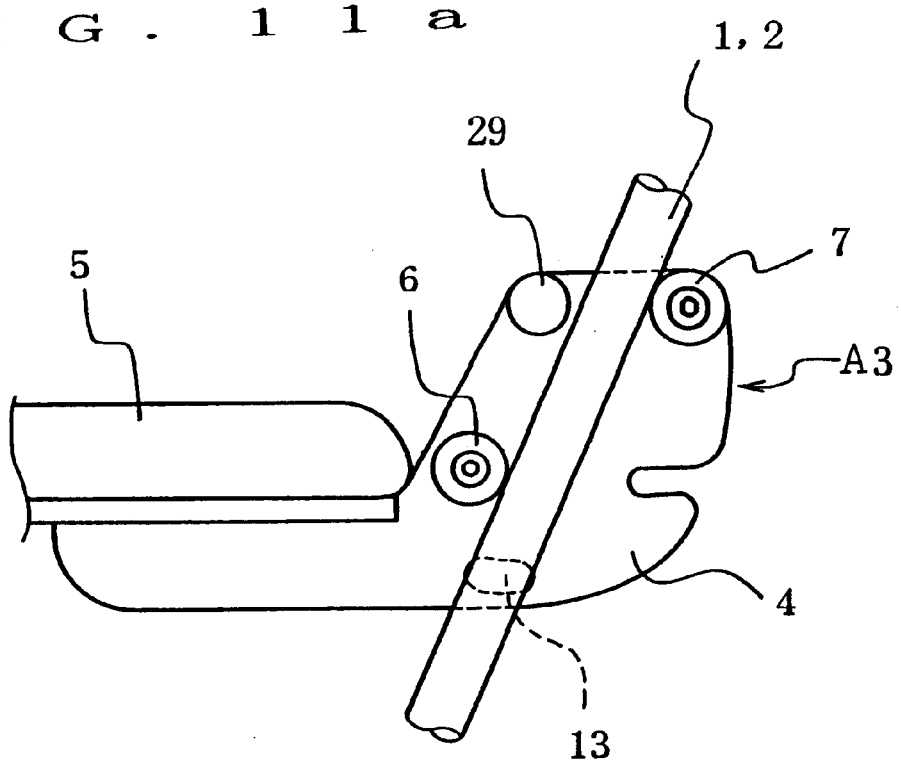
FIGS. 11*a* and 11 are side views showing functions of further another embodiment of the supporting structure of the invention.
Figure 11B:
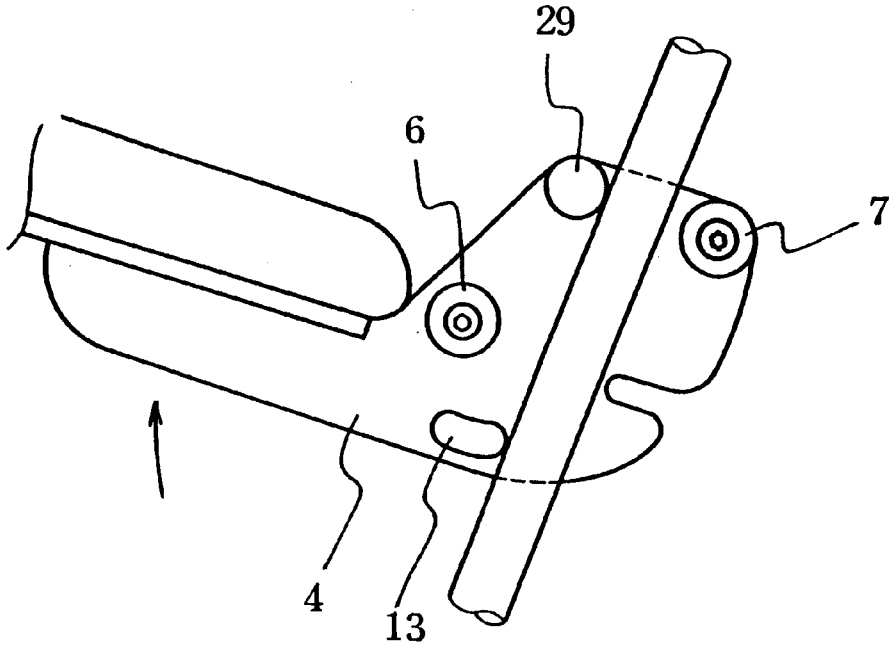

A supporting structure A3 of FIG. 11*a* is basically the same as the supporting structure A of FIG. 1. The projection 13 in the longitudinal direction is shortened, the upper part of the rear portion of the bracket 4 is widened and a pin 29 is provided on the front side of the rear engagement piece 7. The gap between the pin 29 and the rear engagement piece 7 is set to be slightly wider than the width of each of the front leg unit 1 and the auxiliary frame 2. When the front side of the bracket 4 is lifted as shown in FIG. 11*b*, the bracket 4 swings around the contact portion of the pin 29, the front leg unit 1 or the like as a fulcrum. Moreover, since the projection 13 is short, the bracket 4 can be made free with a smaller swing angle as compared with the case of FIG. 4. Another functions and effects of the supporting structure A3 are substantially the same as those of the supporting structure A of FIG. 1 and the like.

Figure 12:
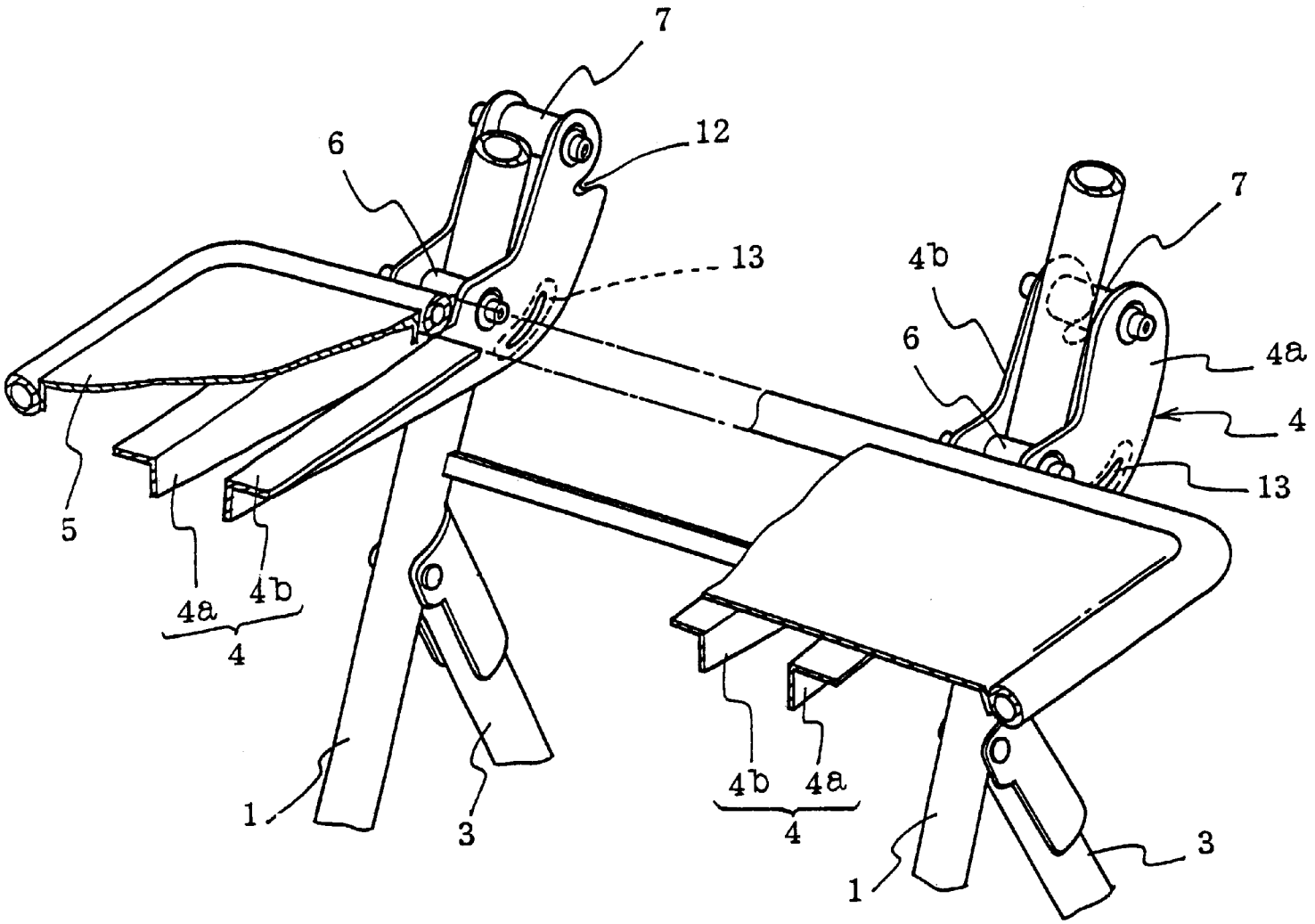
FIG. 12 is a partially notched perspective view showing further another embodiment of the supporting structure of the invention.

In a supporting structure A4 of FIG. 12, the auxiliary frame is omitted, each of the right and left brackets 4 has a construction such that two plate members 4*a* and 4*b* are connected to each other by the front and rear engagement members 6 and 7, spacer, and the like, and the front leg unit 1 extends in a gap between the two plate members. The projection 13 is provided on the inner face of the outer plate member 4*a* and/or the outer face of the inner plate member 4*b*. In FIG. 12, the projection 13 is shown as a recess on the back side. The projection 13 can be provided like in FIG. 2*c* or FIG. 5. The supporting structure A4 also has the actions and effects similar to those of the foregoing embodiments.

In the supporting structure A4 of FIG. 12, either the outer plate member 4*a* or the inner plate member 4*b* of each of the right and left brackets 4 can be omitted. In this case, although each of the front and rear engagement pieces 6 and 7 is cantilever support, substantially the same function and effect of preventing the movement of the seat 5 can be obtained.

Figure 13A:
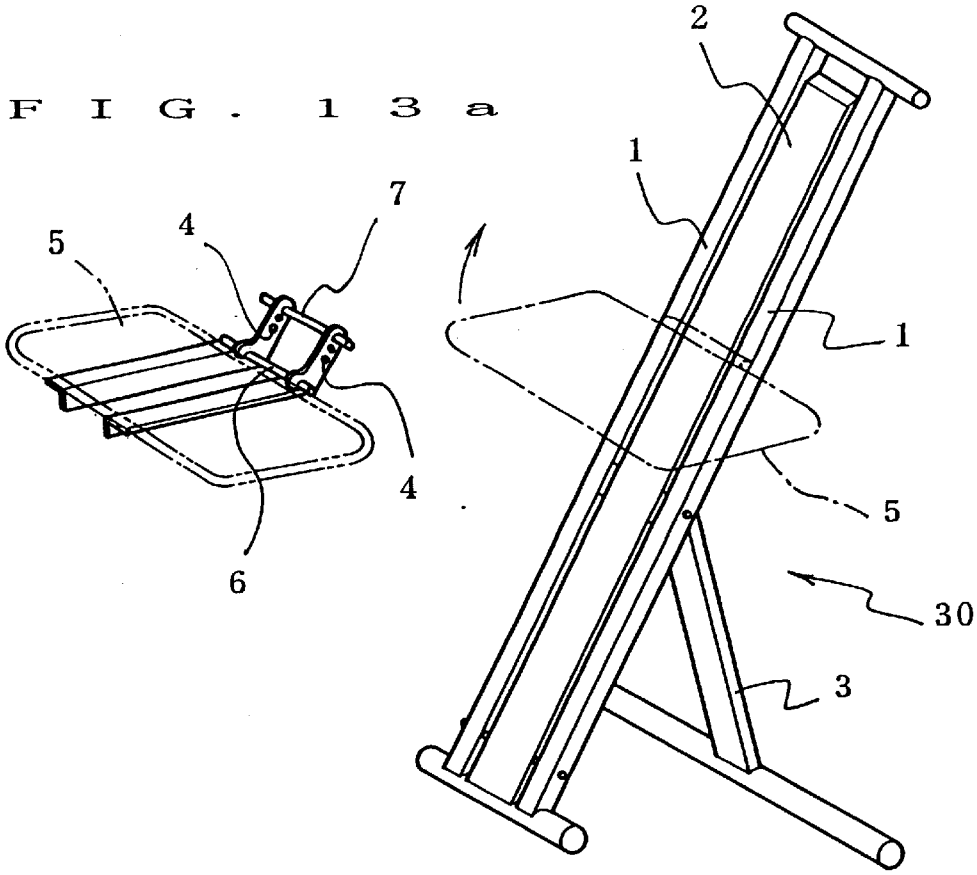
FIGS. 13*a* and 13*b* are a perspective view and a main portion sectional side view showing further another embodiment of the chair having the supporting structure of the invention.
Figure 13B:
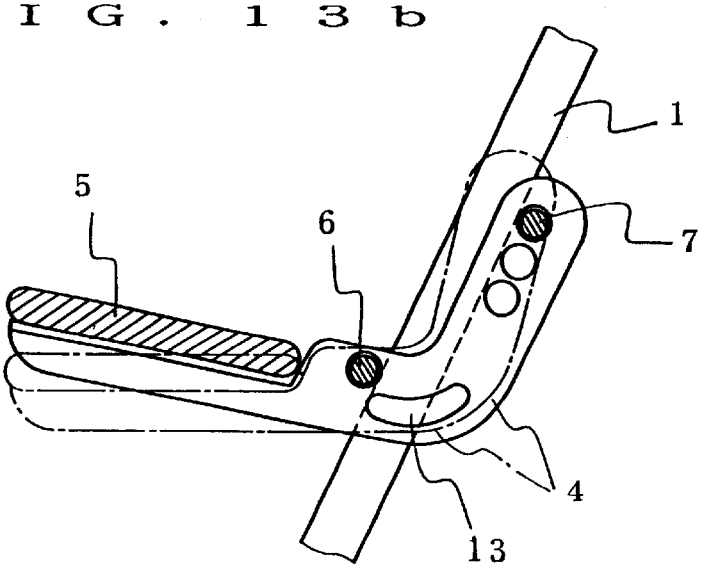
Figure 14A:
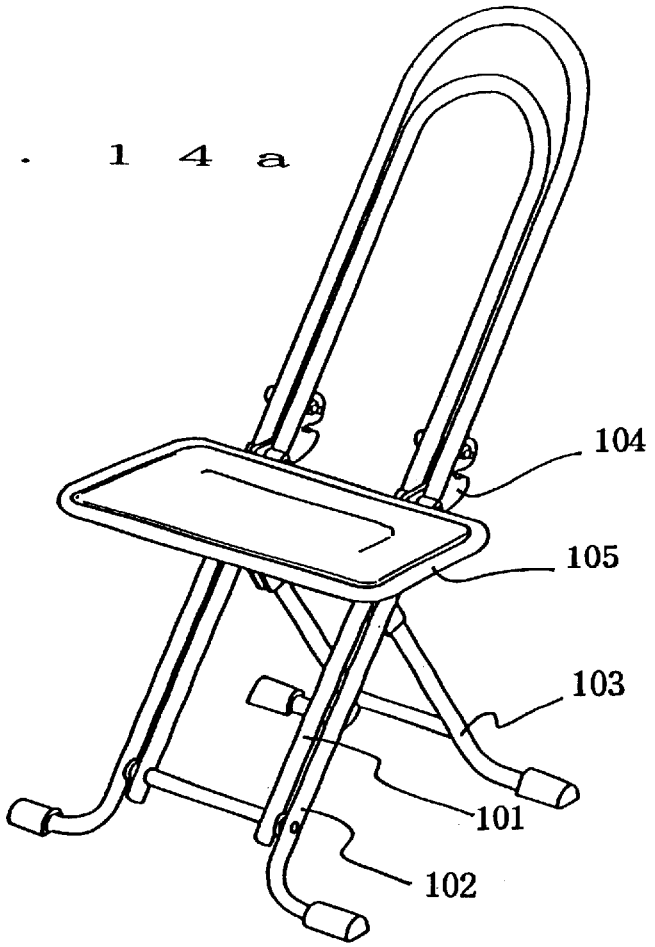
FIG. 14*a* is a perspective view showing an example of a conventional height-adjustable chair.
Figure 14B:
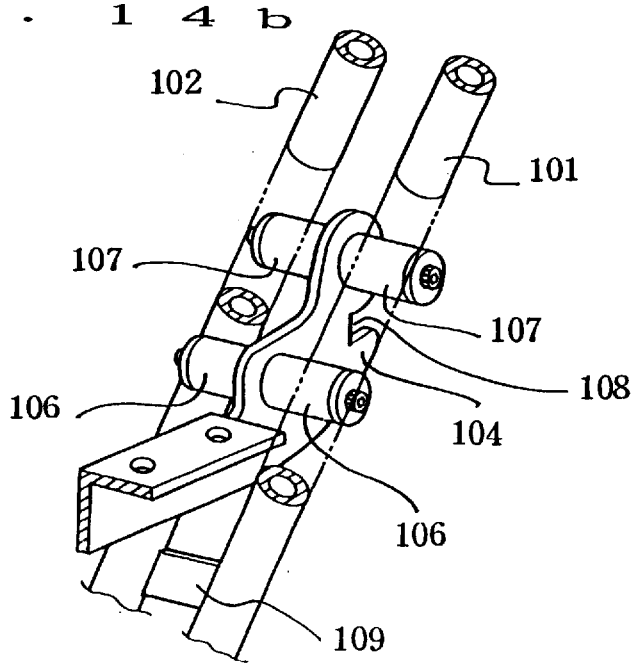
FIG. 14*b* is a partially notched perspective view showing the supporting structure of the chair.

A height-adjustable chair 30 shown in FIG. 13*a* as a pair of right and left front legs 1 each having a late shape or a prism shape and a plate-shaped auxiliary frame 2 disposed between the legs 1. The pair of right and left brackets 4 and 4 is provided with the front engagement piece 6 and the rear engagement piece 7 each having a laterally long stick shape. The attaching position of the rear engagement piece 7 can be selected from three positions as shown in FIG. 13*b*. The angle of the bracket 4 and the seat 5 can be consequently changed at three stages. On one side or both sides of the bracket 4, the projection 13 as a feature of the supporting structure of the invention is provided. When the seat 5 is inclined forward and the folding-type height-adjustable chair becomes usable state, the projection 13 engages with the faces in the gap of the front leg unit 1 and the auxiliary frame 2 with a frictional function. The function and effect such that the seat 5 does not easily slide down and a change in height is suppressed even when the user lifts the seat 5 a little are produced. On the other hand, by largely lifting the front side of the seat 5 to let the projection 13 disengaged from the faces in the gap, the height of the seat can be easily adjusted.

The projection 13 is provided in the rear portion of the bracket 4 in the supporting structure A in FIG. 1 and the like. It is also possible to construct the rear portion in such a manner that the whole rear portion is made thicker, only the region which comes into contact with the front leg unit 1 or the like in a state where the front side of the bracket 4 is lifted (refer to FIG. 4*c*) is made thicker, and a groove is formed in the region. In this case, the wider range in the rear portion serves as a frictional stopper in claim 1.

What is claimed is:

1. A structure for supporting the seat of a height-adjustable chair, the structure comprising:

a leg member longitudinally disposed; and a bracket having a front engagement piece and a rear engagement piece which are disposed on front and rear sides of the leg member, respectively, with spacing larger than the thickness of the leg member, and the bracket being vertically movable along the leg member when the bracket is inclined rearward and being fixed when the bracket is returned forward in a use state and the front and rear engagement pieces come into engagement with the leg member, wherein a frictional stopper is provided on a side face of either the leg member or the bracket, which comes into contact with a side face of the other member with a frictional action in a use state and is disengaged from the side face in a state where the front side of the bracket is lifted.

2. The supporting structure according to claim 1, wherein the leg member has two right and left rod members which are arranged with spacing, a rear portion of the bracket is positioned vertically in the spacing between the rod members, and the frictional stopper is a projection provided on a side face of the rear portion of the bracket so as to come into contact with a side face of the rod member in the use state.

3. The supporting structure according to claim 2, wherein the projections are provided on both faces of the rear portion of the bracket.

4. The supporting structure according to claim 3, wherein the bracket is a plate member, the projections provided on both faces are projection members of the same shape which are disposed on both faces of the plate member, and each of the projection members has a male shaft and a female shaft, the male shaft penetrating a hole formed in the bracket and fixedly fitting to the female shaft.

5. The supporting structure according to claims 1, wherein the frictional stopper is a resilient member made of a high polymer material.

* * * * *